US007731328B2

(12) United States Patent
Jung et al.

(10) Patent No.: US 7,731,328 B2
(45) Date of Patent: Jun. 8, 2010

(54) WIPER AND CLEANING DEVICE, AND INKJET IMAGE FORMING APPARATUS INCLUDING THE SAME

(75) Inventors: Youn-gun Jung, Gunpo-si (KR); Jin-ho Park, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 818 days.

(21) Appl. No.: 11/493,906

(22) Filed: Jul. 27, 2006

(65) Prior Publication Data

US 2007/0046724 A1 Mar. 1, 2007

(30) Foreign Application Priority Data

Sep. 1, 2005 (KR) ..... 10-2005-0081334

(51) Int. Cl.
*B41J 2/165* (2006.01)

(52) U.S. Cl. ..... 347/33; 347/32

(58) Field of Classification Search ..... 347/33, 347/22, 29, 31, 32, 36
See application file for complete search history.

(56) References Cited

U.S. PATENT DOCUMENTS 4,571,601 A * 2/1986 Teshima ..... 347/33
6,382,767 B1 * 5/2002 Greive ..... 347/30
6,692,100 B2 * 2/2004 Steinfield et al. ..... 347/22
6,866,361 B2 3/2005 Kuki et al.
6,866,362 B2 * 3/2005 Kimura et al. ..... 347/33
7,044,580 B2 * 5/2006 Kimura ..... 347/33
7,497,564 B2 * 3/2009 Yui ..... 347/101

(Continued)

FOREIGN PATENT DOCUMENTS

CN 1457982 11/2003

(Continued)

OTHER PUBLICATIONS

Korean Office Action dated Oct. 20, 2006 issued in KR 2005-81334.
Chinese Office Action issued Apr. 4, 2008 in CN 2006-1280537.

*Primary Examiner*—Shih-Wen Hsieh
(74) *Attorney, Agent, or Firm*—Stanzione & Kim, LLP

(57) ABSTRACT

A wiper, a cleaning device, and an inkjet image forming device including the wiper and the cleaning device. The cleaning device includes a carrier moving in a lengthwise direction of a nozzle unit, the length of the nozzle unit corresponding to a width of a printing medium, a driving element moving the carrier forwards and backwards, and a wiper mounted on the carrier and removing ink adhered to the nozzle unit, wherein the wiper includes a belt member which is supported by a plurality of pulleys and circularly moves along a predetermined path and a cleaning member which is attached to an outer circumference of the belt member and removes the ink adhered to the nozzle unit while rotating in contact with the nozzle unit. Accordingly, an absorption capacity of the wiper is increased using the belt type wiper. Furthermore, since the absorption capacity of the wiper is increased, a replacement cycle for replacing the wiper is extended, thereby increasing the life span of the wiper. The ink absorbed into the cleaning member is removed again using a second pressing unit or a cleaning roller, and hence the absorbency of the cleaning member can be maintained and the replacement cycle can be extended.

30 Claims, 9 Drawing Sheets

U.S. PATENT DOCUMENTS

| | | | | |
|---|---|---|---|---|
| 7,510,265 | B2 * | 3/2009 | Kang et al. | 347/33 |
| 2005/0068365 | A1 | 3/2005 | Takagi | |

FOREIGN PATENT DOCUMENTS

| | | | | |
|---|---|---|---|---|
| CN | 1459377 | | 12/2003 | |
| EP | 1 142 716 | A1 | 10/2001 | |
| JP | 406-71904 | A * | 3/1994 | 347/33 |
| JP | 11-221927 | | 8/1999 | |
| JP | 2000-198210 | * | 7/2000 | |
| JP | 2002-240309 | | 8/2002 | |
| KR | 2001-0082815 | | 8/2001 | |

* cited by examiner

WIPER AND CLEANING DEVICE, AND INKJET IMAGE FORMING APPARATUS INCLUDING THE SAME

CROSS-REFERENCE TO RELATED APPLICATIONS

This application claims the priority of Korean Patent Application No. 10-2005-0081334, filed on Sep. 1, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus, and more particularly, to a cleaning device to clean a nozzle surface of a printhead, a length of the nozzle surface corresponding to a width of a printing medium, and an inkjet image forming apparatus including the cleaning device.

2. Description of the Related Art

An inkjet printer is a device for producing images by ejecting ink droplets from a printhead (a shuttle type printhead) onto a printing medium. The printhead is disposed at a predetermined distance from the printing medium and reciprocates in a direction (a widthwise direction of the printing medium) perpendicular to the paper movement.

Recently, high-speed printing has been performed using a printhead (a line printing type printhead) having a nozzle unit of a length corresponding to a width of a printing medium, as an alternative to using a printhead which reciprocates in a widthwise direction of a printing medium. Such a line printing type printhead has a nozzle unit including a plurality of nozzles that eject ink. After the ink is ejected, droplets which have not been ejected onto the printing medium may remain around the nozzle unit. When the nozzle unit is exposed to air during a standby state, the ink droplets not ejected may dry, and air born particulates, such as fine dusts, may be accumulated on the nozzle unit. The dried ink or particulates alter the ejecting direction of ink, thereby deteriorating printing quality. Furthermore, the line printing type printhead has a larger surface area than that of the shuttle type printhead, and thus more ink droplets remain around the nozzle unit. To solve the above problems, an inkjet image forming apparatus that includes a cleaning device that wipes off ink remaining on the surface of the nozzle unit has been developed.

FIG. 1 is a diagram of a printhead 30 and a wiping blade 40 included in an ink cartridge 20 of a conventional inkjet image forming apparatus. FIG. 2 is a view illustrating an enlarged contact portion between the printhead 30 and the wiping blade 40 illustrated in FIG. 1.

Referring to FIGS. 1 and 2, the printhead 30 which includes a plurality of nozzles (not shown) ejecting ink droplets is disposed below an ink cartridge 20 mounted on a carrier 10. Ink droplets ejected from the nozzle unit or other particulates may be easily accumulated on a nozzle surface 32, and thus the nozzle surface 32 of the printhead 30 is required to be cleaned. To this end, the inkjet image forming apparatus includes the wiping blade 40 for cleaning the nozzle surface 32 of the printhead 30. The wiping blade 40 is supported by a holder 50 and installed to move forward and backward. When the wiping blade 40 moves in a direction A, indicated by arrow A in FIG. 1, a leading end of the wiping blade 40 touches the nozzle surface 32 of the printhead 30 while being slightly bent. The wiping blade 40 wipes off the ink or particulates accumulated on the nozzle surface 32 while continuously moving in the direction A and contacting the nozzle surface 32.

A nozzle unit of a line printing type printhead to be cleaned has a length corresponding to a width of a printing medium. Therefore, waste toner removed from a nozzle array by the wiping blade 40 contaminates another nozzle array. Consequently, printing quality is deteriorated.

Further, the nozzle surface 32 of the printhead 30 is generally coated with a hydrophobic layer 34 to prevent ink from staining the nozzle surface 32. However, as the wiping blade 40 repeatedly performs a cleaning operation on the nozzle surface 32 of the printhead 30, the hydrophobic layer 34 is worn down due to repeated friction, thereby losing hydrophobic properties thereof. In this case, the nozzle surface 32 of the printhead 30 is easily contaminated by waste ink, and thus the printing quality can be deteriorated. Consequently, the conventional wiping blade 40 wears down the hydrophobic layer 34, thereby reducing the durability of the hydrophobic layer 34. Such a problem can be solved by using a wiper of a roller type instead of the wiping blade 40.

Japanese Patent Laid-open Publication No. JP2002-240309 discloses a roller type wiper. Since the roller type wiper has a limited cleaning capacity, the cleaning performance is lowered in time, and hence the wiper should be replaced after printing a predetermined number of sheets of paper. To increase the life span of the wiper, the radius of a roller should be increased, but this is difficult to realize because of a limited installation space. Therefore, an improvement in the wiper is needed.

SUMMARY OF THE INVENTION

The present general inventive concept provides a wiper having an increased cleaning capacity and cleaning performance, a cleaning device, and an inkjet image forming apparatus including the wiper and the cleaning device.

The present general inventive concept also provides a wiper that can prevent a nozzle unit from being contaminated by ink removed from another nozzle unit, a cleaning device, and an inkjet image forming apparatus including the wiper and the cleaning unit.

Additional aspects and advantages of the present general inventive concept will be set forth in part in the description which follows and, in part, will be obvious from the description, or may be learned by practice of the general inventive concept.

The foregoing and/or other aspects of the present inventive concept may be achieved by providing a wiper including a belt member which is supported by a plurality of pulleys and circularly moves along a predetermined path, and a cleaning member which is attached to an outer circumference of the belt member and removes ink adhered to a nozzle unit while rotating in contact with the nozzle unit.

The cleaning member may include a porous absorbent material. The cleaning member may be a high polymer absorbent material such as acrylonitrile.

The cleaning member may include a color mixing preventing unit which prevents ink of a predetermined color removed from a nozzle unit during a cleaning operation from contaminating another nozzle ejecting ink of a different color. The color mixing preventing unit may be a groove formed in a portion of the cleaning member at a predetermined depth, the portion corresponding to a position between adjacent nozzles ejecting ink of different colors.

The cleaning member may be formed by dividing the cleaning member into separate portions such that each of the separate portions contacts a corresponding plurality of nozzles and each of the corresponding plurality of nozzles of the corresponding separate portion ejects a particular color of ink.

The cleaning member may be formed of a high polymer absorbent material. The high polymer absorbent material may be acrylonitrile.

The belt member may include cogs formed on an inner circumference thereof. The belt member may be a timing belt.

The foregoing and/or other aspects of the present inventive concept may also be achieved by providing a cleaning device including a carrier moving in a lengthwise direction of a nozzle unit, the length of the nozzle unit corresponding to a width of a printing medium, a driving element moving the carrier forwards and backwards, and a wiper mounted on the carrier and removing ink adhered to the nozzle unit, wherein the wiper includes a belt member which is supported by a plurality of pulleys and circularly moves along a predetermined path and a cleaning member which is attached to an outer circumference of the belt member and removes the ink adhered to the nozzle unit while rotating in contact with the nozzle unit.

The cleaning member may include a porous absorbent material.

The cleaning member may include a color mixing preventing unit which prevents ink of a predetermined color removed from a nozzle unit during a cleaning operation from contaminating another nozzle ejecting ink of a different color. The color mixing preventing unit may be a groove formed on a portion of the cleaning member at a predetermined depth, the portion corresponding to a position between adjacent nozzles ejecting ink of different colors.

The cleaning member may be formed by dividing the cleaning member into portions such that each of the portions contacts nozzles ejecting ink of a same color.

The cleaning device may further comprise a first pressing unit installed in the carrier and to press an inner circumference of the belt member such that the cleaning member contacts the nozzle unit. The first pressing unit may include a roller.

The cleaning device may further include a second pressing unit installed opposite to one of pulleys to squeeze absorbed ink by pressing the outer circumference of the cleaning member. The cleaning device may further include a cleaning roller removing the squeezed ink while rotating in contact with the second pressing unit. A porous absorbent material may be formed on an outer circumference of the cleaning roller.

The plurality of pulleys may include a driving pulley, an idle pulley, and a first pressing unit.

The carrier of the cleaning device may include a housing to house the plurality of pulleys which may include a driving pulley mounted a driving axis in the housing to drive the wiper circularly in the predetermined path, an idle pulley mounted on an idle axis in the housing, and a first pressing unit to press outwardly on an inner circumference of the wiper to put tension on the wiper.

The wiper may surround the driving pulley, idle pulley, and first pressing unit and have saw teeth to engage cogs on the belt member. The driving pulley may be a timing pulley. The first pressing unit may be a roller.

A pinion may be attached to the driving pulley and be rotatably mounted to engage a rack gear to circularly drive the wiper in the carrier.

The tension on the wiper may be a predetermined pressure which is the pressure necessary to cause a distance between the first pressing unit and the nozzle unit to be less than a thickness of the wiper.

The foregoing and/or other aspects of the present inventive concept may also be achieved by providing an inkjet image forming apparatus including a cleaning device that cleans a nozzle unit length of which corresponds to a width of a printing medium, the inkjet image forming apparatus including a carrier to move in a lengthwise direction of the nozzle unit, a driving element to move the carrier forwards and backwards, and a wiper mounted on the carrier and to remove ink adhered to the nozzle unit, wherein the wiper includes a belt member which is supported by a plurality of pulleys and circularly moves along a predetermined path and a cleaning member which is attached to an outer circumference of the belt member and removes the ink adhered to the nozzle unit while rotating in contact with the nozzle unit.

The cleaning member may include a porous absorbent material.

The cleaning member may include a color mixing preventing unit which prevents ink of a predetermined color removed from a nozzle unit during a cleaning operation from contaminating another nozzle ejecting ink of a different color.

The inkjet image forming apparatus may further include a first pressing unit installed in the carrier and to press an inner circumference of the belt member such that the cleaning member contacts the nozzle unit with a predetermined pressure.

The inkjet image forming apparatus may further include a second pressing unit installed opposite to one of the plurality of pulleys to squeeze absorbed ink by pressing the outer circumference of the cleaning member. The inkjet image forming apparatus may further include a cleaning roller to remove the squeezed ink while rotating in contact with the second pressing unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
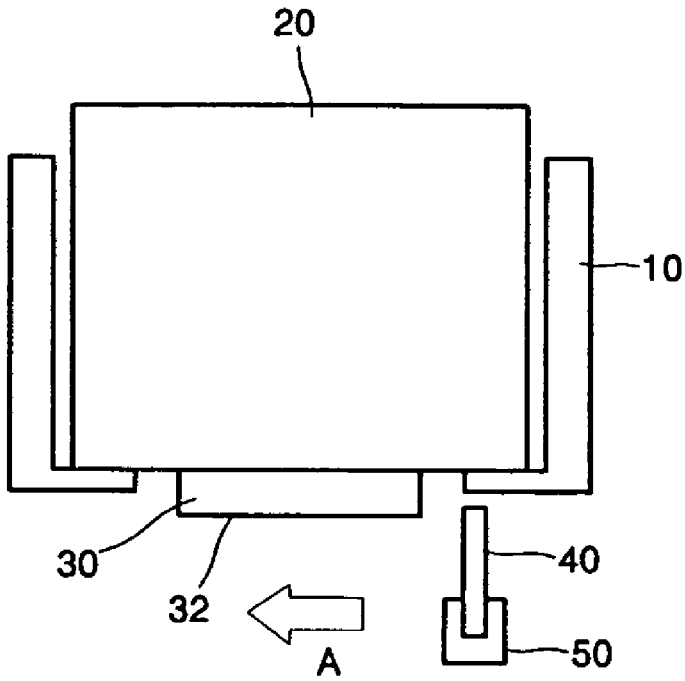
FIG. 1 (PRIOR ART)
FIG. 1 is a diagram illustrating a printhead and a wiping blade included in an ink cartridge of a conventional inkjet image forming apparatus.
Figure 2:
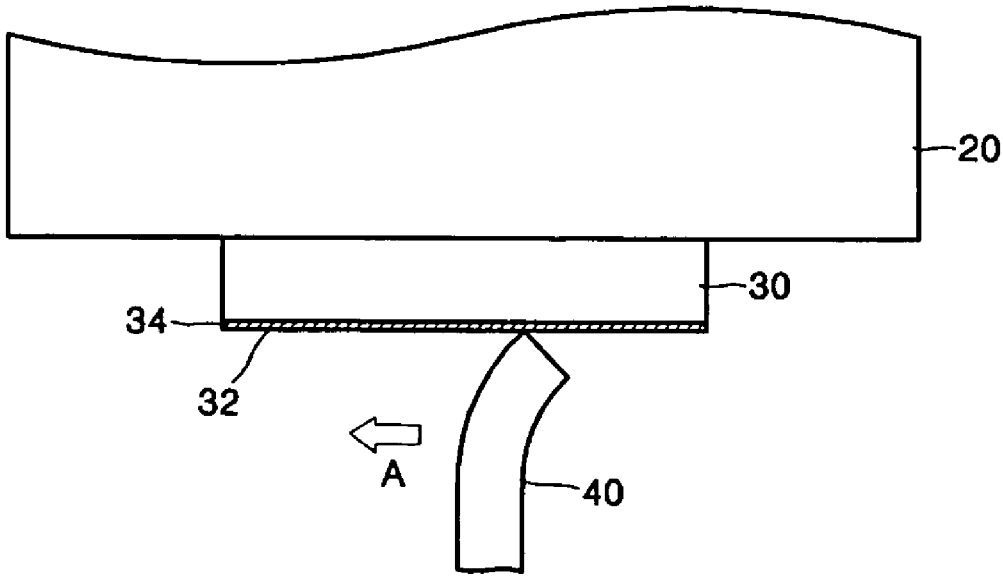
FIG. 2 (PRIOR ART)
FIG. 2 is a view illustrating an enlarged contact portion between the printhead and the wiping blade illustrated in FIG. 1.

The attached drawings for illustrating exemplary embodiments of the present inventive concept are referred to in order to gain a sufficient understanding of the present inventive concept, the merits thereof, and the objectives accomplished by the implementation of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
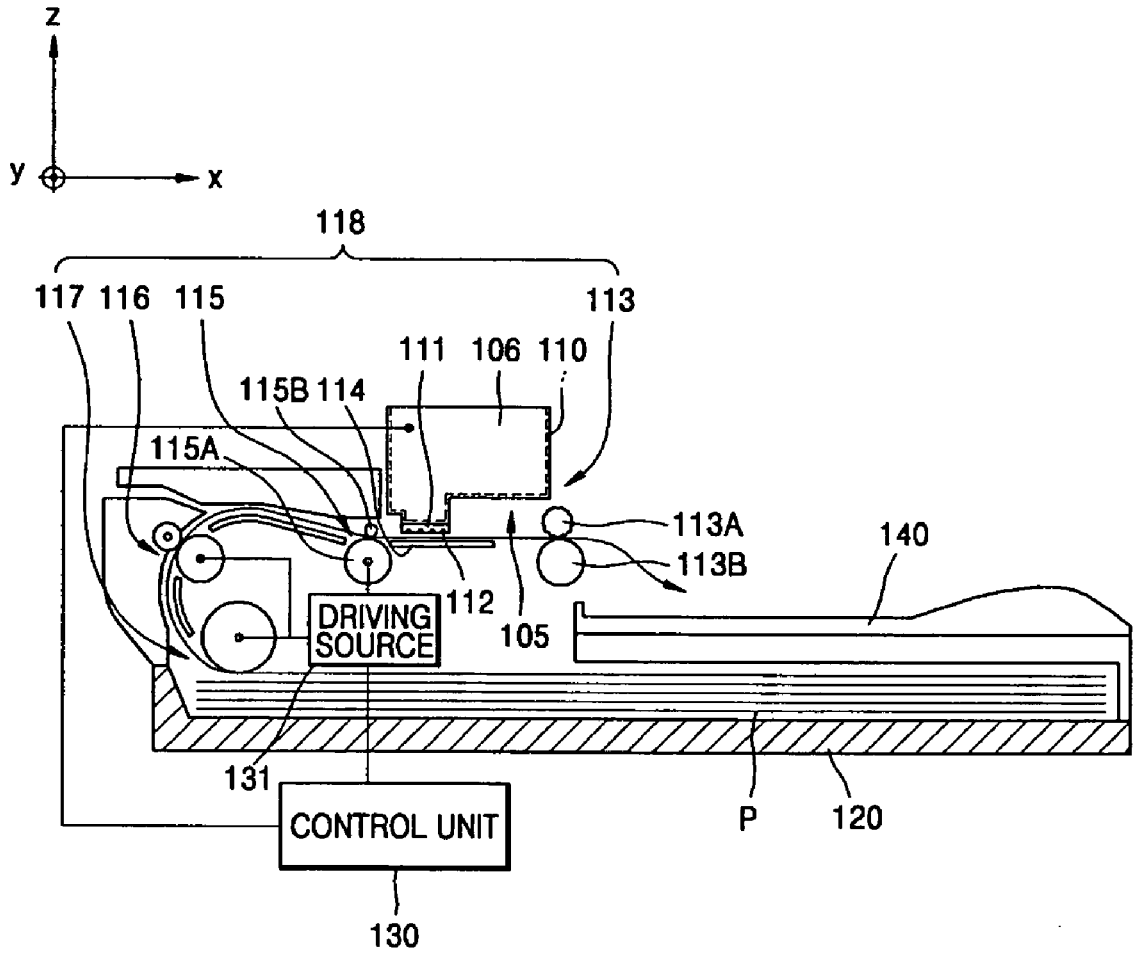
FIG. 3 illustrates a cross-sectional view of an inkjet image forming apparatus according to an embodiment of the present general inventive concept.

FIG. 3 is a cross-sectional view schematically illustrating an inkjet image forming apparatus according to an embodiment of the present inventive concept.

Referring to FIG. 3, the inkjet image forming apparatus includes a paper feeding cassette 120, a printhead unit 105, a supporting member 114 disposed to face the printhead unit 114, a printing medium conveying unit 118 that can convey a printing medium P in a first direction (direction X), a stacking unit 140 in which the printing medium P can be stacked after being discharged, and a cleaning device (not shown, see FIG. 5) that cleans ink adhered to a nozzle unit 112. Furthermore, the inkjet image forming apparatus can include a control unit 130 that controls operations of each element therein.

The printing medium P can be contained in the paper feeding cassette 120. The printing medium P can be conveyed from the paper feeding cassette 120, passing along a printhead 111, to the stacking unit 140 by the printing medium conveying unit 118, which will be described later. The printing medium P on which an image has been printed may be stacked in the stacking unit 140, as for example, in a discharging tray.

The printing medium conveying unit 118, which can move the printing medium P contained in the paper feeding cassette 120 along a predetermined path, includes a pickup roller 117, auxiliary rollers 116, a feeding roller unit 115, and a discharging roller unit 113. The printing medium conveying unit 118 can be driven by a driving source 131 such as a motor, and may provide a moving force to convey the printing medium P. An operation of the driving source 131 may be controlled by the control unit 130 which will be described later.

The pickup roller 117 may be installed at an inner side of the paper feeding cassette 120, and can draw out the printing medium P stacked in the paper feeding cassette 120 by picking up the printing medium P one by one. The feeding roller unit 115 may be installed at a side of the printhead 111, and can convey the drawn out printing medium P to the printhead 111. The feeding roller unit 115 may further include a driving roller 115A that provides a moving force to the printing medium P, and an idle roller 115B that is elastically engaged with the driving roller 115A. A pair of auxiliary rollers 116 may be further installed between the pickup roller 117 and the feeding roller unit 115 to convey the printing medium P. The discharging roller 113 may be installed in a portion where the printing medium P is drawn out from the printhead 111, and can discharge the printing medium P on which an image has been printed to an outside of the image forming apparatus. The discharging roller unit 113 may include a star wheel 113A installed parallel to a widthwise direction of the printing medium P, and a supporting roller 113B that may be opposite to the star wheel 113A and may support a rear side of the printing medium P. The printing medium P discharged from the image forming apparatus can be stacked in the stacking unit 140.

The supporting member 114, which can be formed below the printhead 111 such that the nozzle unit 112 may be a predetermined distance apart from the printing medium P, can support the rear side of the printing medium P while the printing medium P is being conveyed. The predetermined distance between the nozzle unit 112 and the printing medium P may be between 0.5 and 2.5 mm.

The control unit 130 can be mounted on a mother-board of the image forming apparatus, and can control an ejecting operation of the nozzle unit 112, a conveying operation of the printing medium conveying unit 118, and a cleaning operation of the cleaning device.

The printhead unit 105 which can print an image by ejecting ink onto the printing medium P may include the printhead 111 formed on a side of a body 110, the nozzle unit 112 formed on the printhead 111, and a frame 106 in which the body 110 is mounted. The feeding roller 115 may be installed in a portion of the nozzle unit 112 where the printing medium P is fed in, and the discharging roller unit 113 is rotatably installed in a portion of the nozzle unit 112 where the printing medium P is drawn out.

Figure 4:
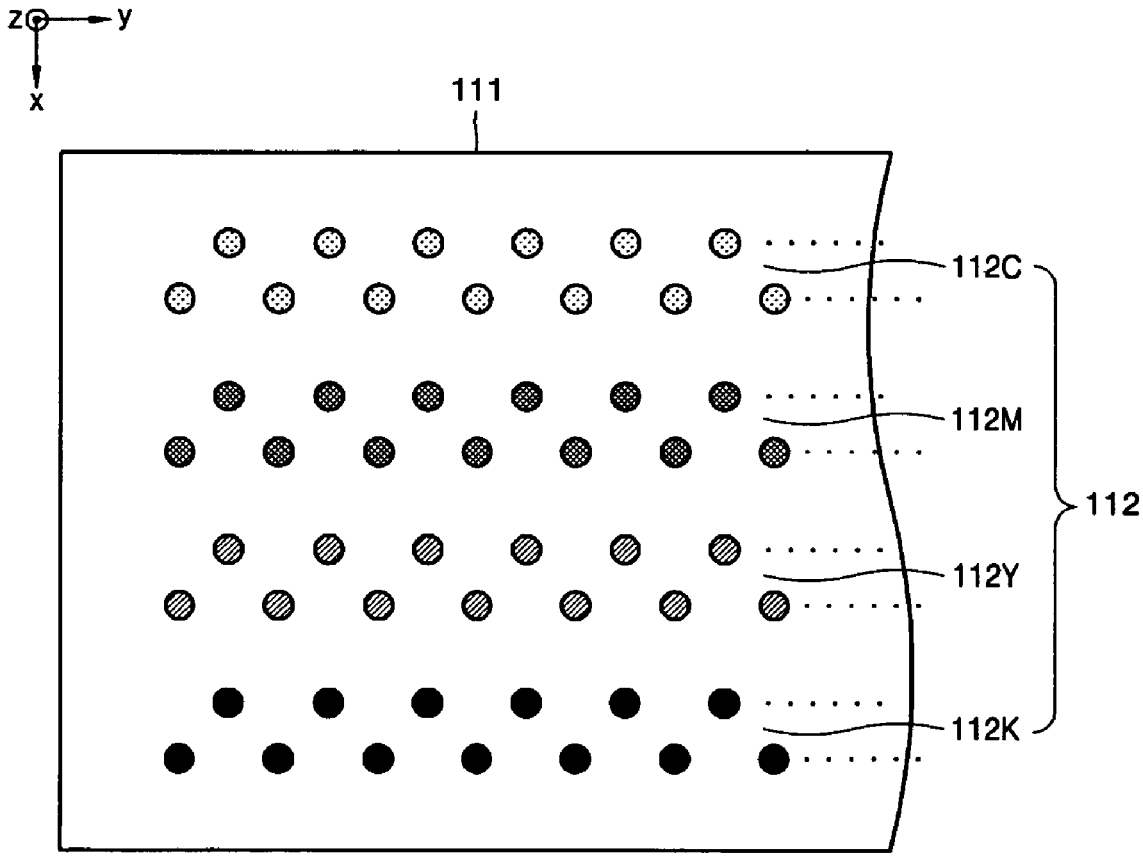
FIG. 4 illustrates a bottom view of the printhead illustrated in FIG. 3.

FIG. 4 illustrates a bottom view of the printhead illustrated in FIG. 3.

Referring to FIGS. 4 and 3, the printhead 111 may be installed in a second direction (direction Y) while the printing medium P is conveyed in the first direction (direction X). The printhead 111 includes the nozzle unit 112. The nozzle unit 112 may be of a length corresponding to a width of the printing medium P, or longer than the width of the printing medium P. The nozzle unit 112 may include nozzle arrays 112C, 112M, 112Y, and 112K which can form an image on the printing medium P by ejecting different colors of ink to the printing medium P. In the present embodiment of the general inventive concept, reference numerals 112C, 112M, 112Y, and 112K denote nozzle arrays and correspond to colors produced by using cyan ink, magenta ink, yellow ink, and black ink, respectively. Moreover, although not illustrated, nozzles on the nozzle unit 112 may be individually connected to a driving circuit and a cable through which a driving signal from the control unit 130, electrical power, and image data may be transmitted. The cable may be a flexible cable such as a flexible printed circuit (FPC) or a flexible flat cable (FFC).

Although not illustrated, the body 110 may further include chambers having a driving element (for example, a piezoelectric element or a heat driving type heater) which may be connected to each nozzle of the nozzle unit 112 and provides pressure for ejecting ink, an ink path (for example, an orifice) to provide ink from the body 110 to the chambers, a manifold that is a common ink path through which the ink is provided to the chambers, and a restrictor that is an individual ink path to provide the ink from the manifold to each of the chambers. The printhead unit having the above structure according to the present embodiment which may include chambers, driving elements, etc., is well-known to those of ordinary skill in the art, and thus a detailed description of the printhead unit will not be described.

The nozzle unit 112 may be easily contaminated by ink or other substances remaining thereon after ink is ejected from the nozzles. Such remaining ink or substances can deteriorate the printing quality, and thus such remaining ink or substances should be removed from the nozzle unit 112.

Figure 5:
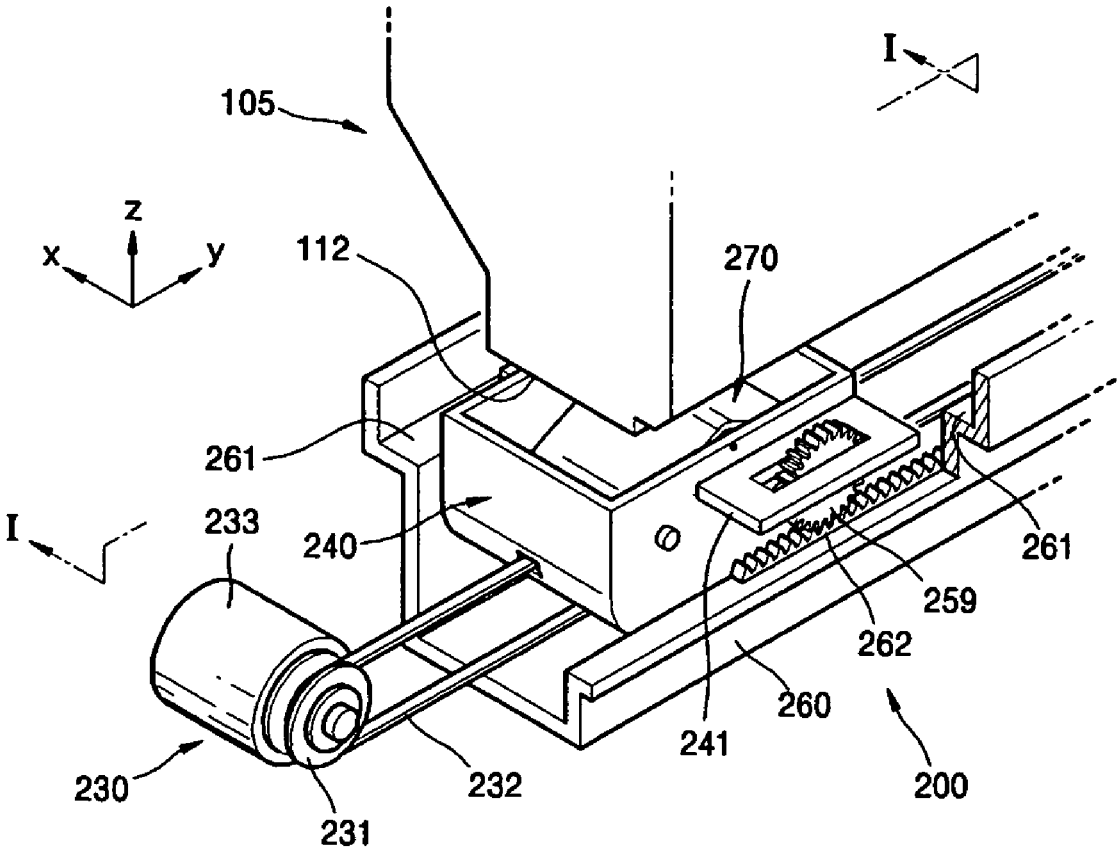
FIG. 5 illustrates a perspective view of a cleaning device according to an embodiment of the present general inventive concept.
Figure 6:
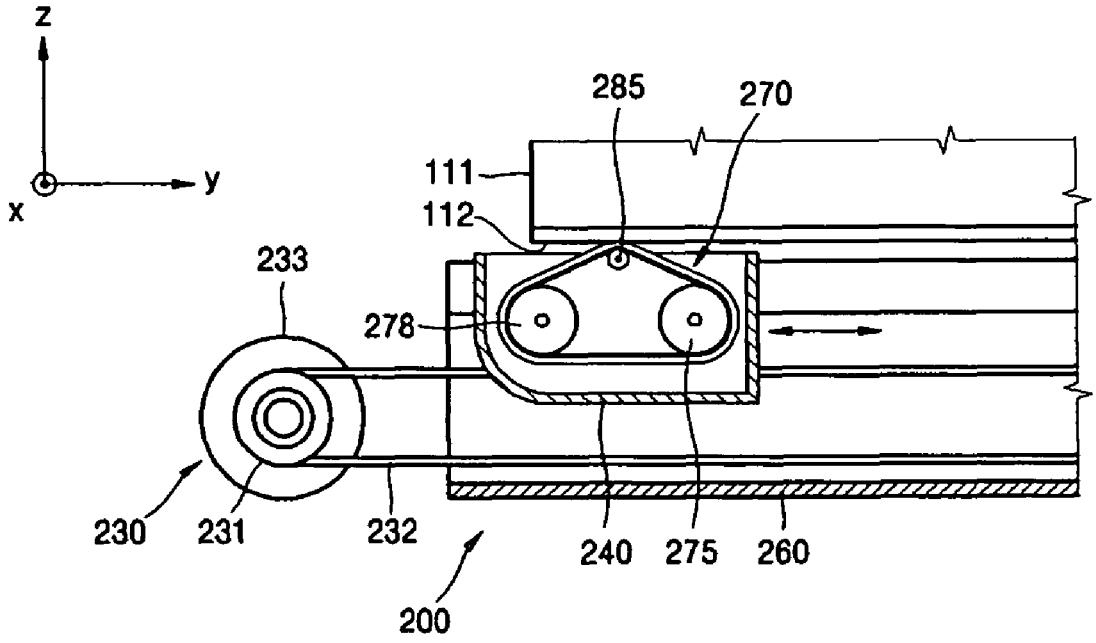
FIG. 6 illustrates a cross-sectional view taken along line I-I in FIG. 5.
Figure 7:
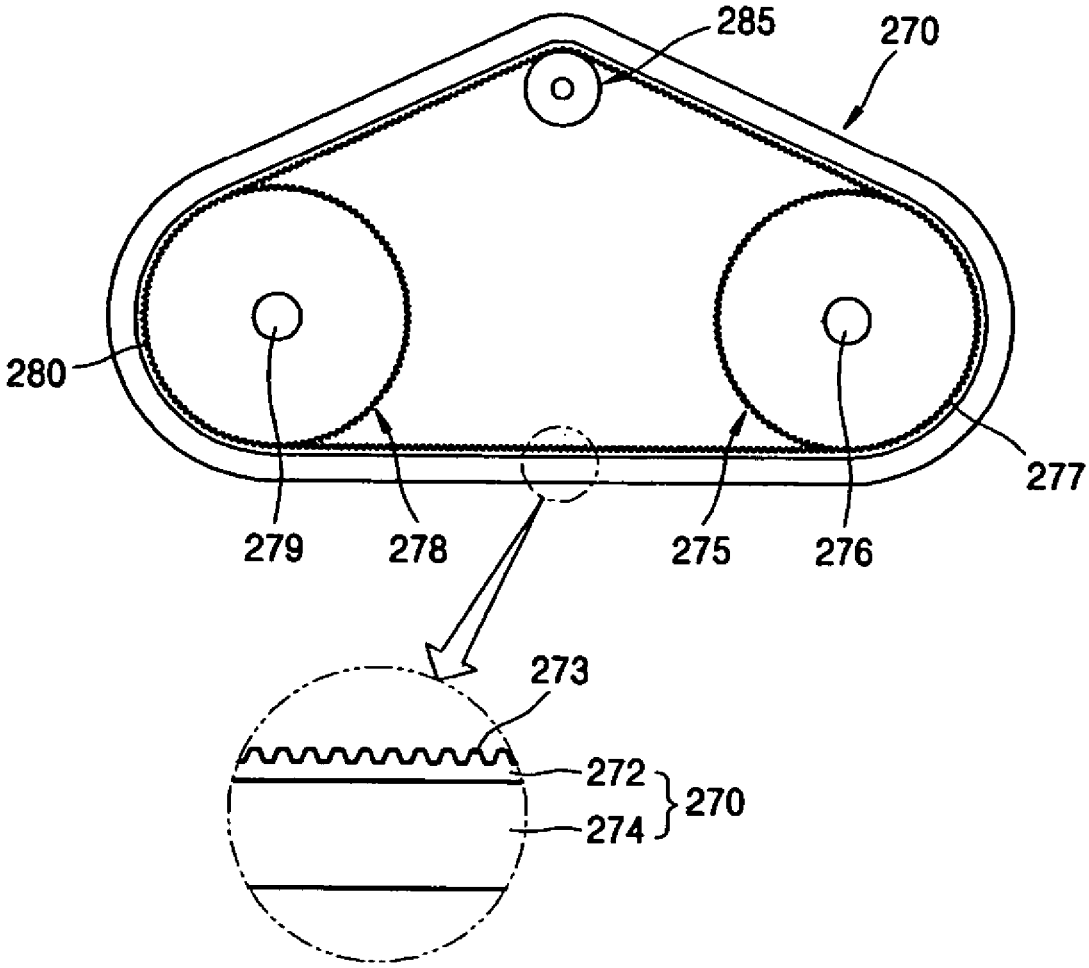
FIG. 7 is a side view illustrating a structure of a wiper mounted in a carrier.
Figure 8:
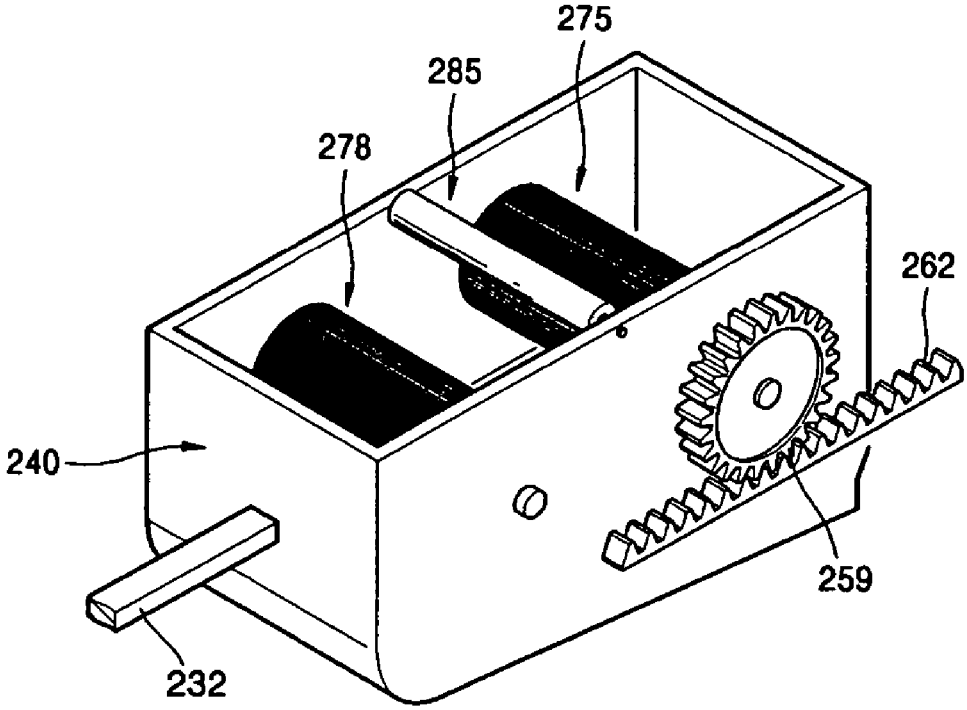
FIG. 8 illustrates a perspective view of a carrier unit illustrated in FIG. 5.
Figure 9:
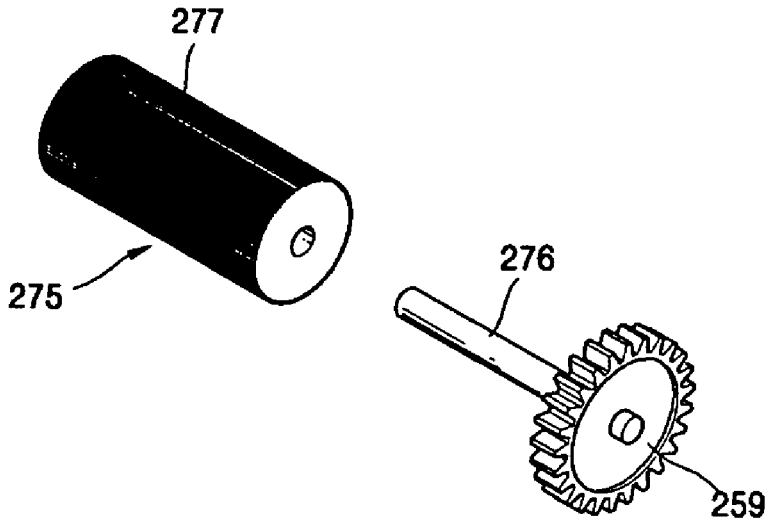
FIG. 9 illustrates an exploded perspective view of a driving pulley illustrated in FIG. 8.
Figure 10:
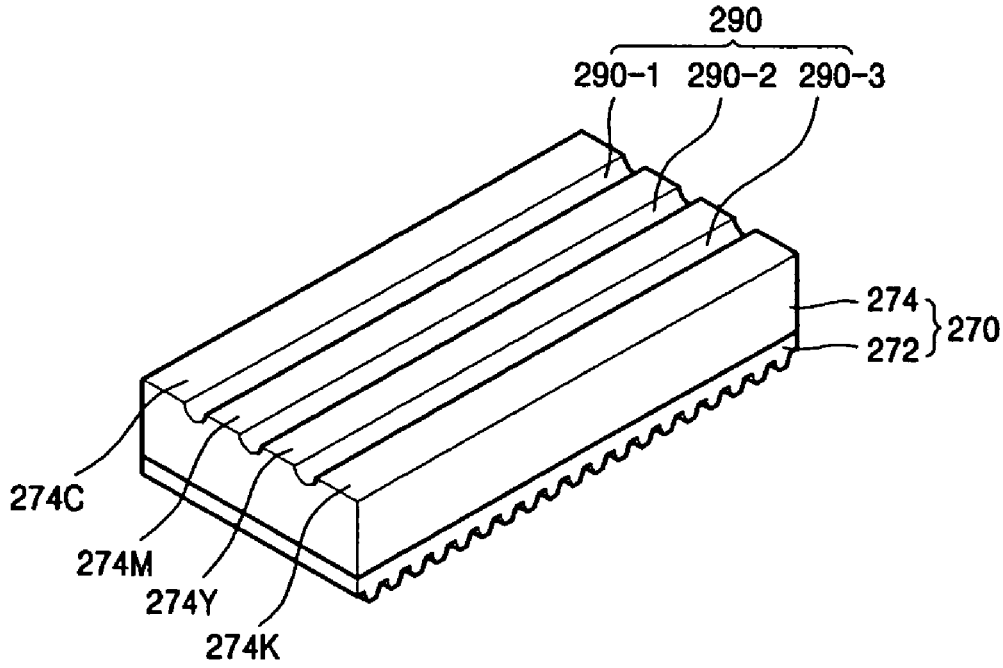
FIG. 10 illustrates a view of a wiper according to an embodiment of the present general inventive concept.
Figure 11:
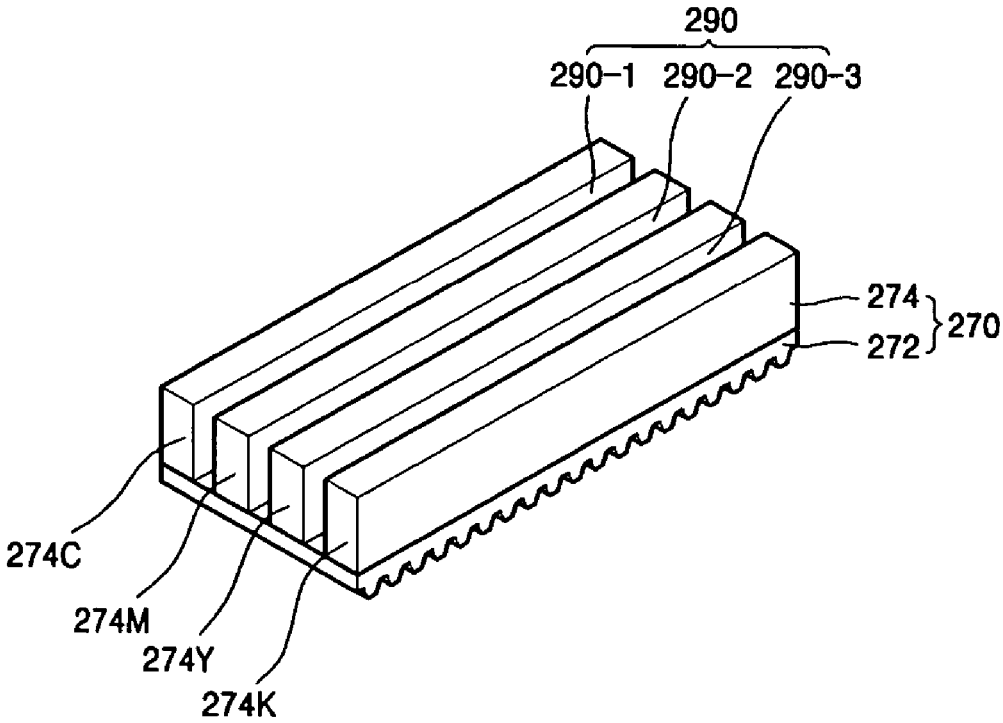
FIG. 11 illustrates a view of a wiper according to another embodiment of the present general inventive concept.

FIG. 5 illustrates a perspective view of a cleaning device 200 according to an embodiment of the present general inventive concept. FIG. 6 illustrates a cross-sectional view taken along line I-I in FIG. 5. FIG. 7 is a side view illustrating a structure of a wiper 270 mounted in a carrier 240. FIG. 8 is a perspective view of a carrier unit illustrated in FIG. 5, and FIG. 9 illustrates an exploded perspective view of a driving pulley 275 illustrated in FIG. 8. Moreover, FIG. 10 illustrates a view of a wiper 270 according to an embodiment of the present general inventive concept, and FIG. 11 illustrates a view of a wiper 270 according to another embodiment of the present general inventive concept.

Referring to FIGS. 5 and 6, the cleaning device 200 may include a driving element 230, a carrier 240, and a wiper 270.

The driving element 230 can move the carrier 240 in a lengthwise direction of the nozzle unit 112, and may include a driving motor 233 which normally or reversely rotates, a pulley 231 rotated by the driving motor 233, and a belt which travels forwards and backwards in a second direction (direction Y) while being supported by the pulley 231.

The carrier 240 may be installed to move in the second direction (direction Y) which is the lengthwise direction of the nozzle unit 112. The carrier 240 is connected to the belt 232, and moves in the second direction (direction Y) when the driving motor 233 rotates. In the present embodiment, a guide surface 241, which may be formed on one side of the carrier 240 and supported by a rail 261 which may be formed on a frame 260, can guide a moving path of the carrier 240. According to the above structure, the carrier 240 can move forwards and backwards in conjunction with the normal and reverse rotation of the driving motor 233. In the present embodiment, a driving force of the driving motor 233 can be transmitted to the carrier 240 through the belt 232, but this is only an exemplary embodiment of the general inventive concept, and thus the technical scope of the present general inventive concept is not limited thereto. For example, the driving force of the driving motor 233 may be transmitted to the carrier 240 through a gear connection. A wiper 270 may be installed inside the carrier 240 to remove ink adhered to the nozzle unit 112.

Referring to FIGS. 5 and 7, the wiper 270 may include a belt member 272 circularly moving along a predetermined path, and a cleaning member 274, which may be attached to an outer circumference of the belt member 272, to remove ink adhered to the nozzle unit 112 while rotating in contact with the nozzle unit 112.

The belt member 272 may be supported by a plurality of pulleys and can circularly move along a predetermined path. In the present embodiment, the belt member 272 can move circularly while being supported by a driving pulley 275, an idle pulley 278, and a first pressing unit 285, as illustrated in FIG. 7. Cogs 273 which engage with the driving pulley 275 and the idle pulley 278 may be formed on an inner circumference of the belt member 272. For instance, the belt member 272 may be a timing belt. In the present embodiment, the belt member may include cogs, but this is only an exemplary embodiment of the present general inventive concept, and thus, the technical scope of the present inventive concept is not limited thereto.

As illustrated in FIGS. 7 and 8, the driving pulley 275, the idle pulley 278, and the first pressing unit 285, which support the belt member 272, may be installed on the inner circumference of the belt member 272. In the present embodiment, the belt member 272 can be supported by the driving pulley 275 and the idle pulley 278.

As illustrated in FIGS. 5 and 9, the driving pulley 275 may be connected to a driving axis 276, a side of which is connected to a pinion 259. The pinion 259 engages with a rack gear 262 which may be formed in the frame 260. The driving force can be transmitted to the carrier 240 via the belt 232 when the driving motor 233 rotates. At this time, the belt member 272, supported by the driving pulley 275, rotates in contact with the nozzle unit 112 and removes the ink adhered to the nozzle unit 112. The saw teeth 275 that intercomplementarily engage with the cogs of the belt member 272 can be formed on an outer circumference of the driving pulley 275 to effectively transmit a rotation force of the driving pulley 275 to the belt member 272. For example, the driving pulley 275 may be a timing pulley.

The idle pulley 278 may be installed in the carrier 240 in parallel with the driving pulley 275. Specifically, an idle axis, to which the idle pulley 278 may be connected, may be rotatably connected to a connection hole formed on the carrier 240. Saw teeth 280 may be also formed on the idle pulley 278. As an example, a bias element (not shown) that biases the wiper 270 away from the driving axis 276 may further be installed in the idle axis 279 to supply a tension force to the wiper 270. The bias element may be an extension spring. Although not illustrated, a pinion may be connected to a side of the idle axis 279 to engage with the rack gear 262.

The cleaning member 274 removes ink adhered to a nozzle surface of the nozzle unit 112 while rotating in contact with the nozzle surface. The cleaning member 274 can rotate in contact with the nozzle unit 112 with a predetermined pressure to improve cleaning efficiency. Referring to FIGS. 7 and 8, the first pressing unit 285 which may be installed in the carrier 240 presses the inner circumference of the belt member 272 toward the nozzle unit 112 such that the cleaning member 274 contacts the nozzle unit 112 with the predetermined pressure. For example, if the first pressing unit 285 is installed in the carrier 240 such that a distance between the first pressing unit 285 and the nozzle unit 112 is less than the thickness of the wiper 270, the cleaning member 274 can remove the ink adhered to the nozzle unit 112 while contacting the nozzle unit 112 and rotating with the predetermined pressure. Alternatively, a bias element (not shown) may be installed in one side of the first pressing unit 285 to bias the first pressing unit 285 toward the nozzle unit 112 with the predetermined pressure. As an example, the first pressing unit 285 may be of a roller type to enable the wiper 270 to freely rotate.

As described above, the cleaning member 274 may remove the ink adhered to the nozzle unit 112 while rotating in contact with the nozzle unit 112. As an example, the cleaning member 274 may include a porous absorbent material to improve ink-removing performance. Alternatively, a high polymer absorbent material such as acrylonitrile may be used to form the cleaning member 274.

The cleaning member 274 removes the ink in a lengthwise direction of the nozzle unit 112 while rotating in contact with the nozzle unit 112. Thus, it is possible that a nozzle ejecting ink of a predetermined color may be contaminated by another color of ink removed during a previous cleaning operation. Accordingly, a color mixing preventing unit 290 (FIG. 10) may be formed on a portion of the cleaning member 274 which contacts the nozzle unit 112 and prevents the nozzle, which ejects the predetermined color ink, from being contaminated by another color of ink removed during the previous cleaning operation.

As illustrated in FIG. 10, the color mixing preventing unit 290 may include a plurality of grooves 290-1, 290-2, and 290-3 of a predetermined depth formed between nozzles ejecting ink of different colors. Referring to FIGS. 4 and 10, reference numerals 274C, 274M, 274Y, and 274K clean a cyan nozzle array 112C, a magenta nozzle array 112M, a yellow nozzle array 112Y, and a black nozzle array 112K, respectively. The respective grooves 290-1, 290-2, and 290-3 formed on the cleaning member 274 prevent the ink removed from each of the nozzle arrays from contaminating adjacent nozzle arrays. Therefore, the contamination of a nozzle due to different color inks removed during cleaning can be prevented.

According to another embodiment of the present general inventive concept, as illustrated in FIG. 11, the cleaning member 274 may be formed to be divided into separate portions each of which contacts a corresponding plurality of nozzles, each of the plurality of corresponding nozzles of the corresponding separate portion ejecting a particular color of ink. Other than the fact that the cleaning member 274 is divided into separate portions corresponding to separate color nozzles, the structure and effects of the embodiment illustrated in FIG. 11 are similar to the embodiment illustrated in FIG. 10, and thus the detailed description thereof will be omitted.

Ink removed from nozzle unit 112 may be absorbed by a cleaning member 274. In the present general inventive concept, a belt type wiper 270 may be used to improve absorption capacity of the wiper 270. That is, a cleaning capacity of the wiper 270 can be increased using a belt type cleaning member 274 circularly moving along an infinite path. To increase a life span of the cleaning member 274, the ink absorbed into the cleaning member 274 is desirably removed.

Figure 12:
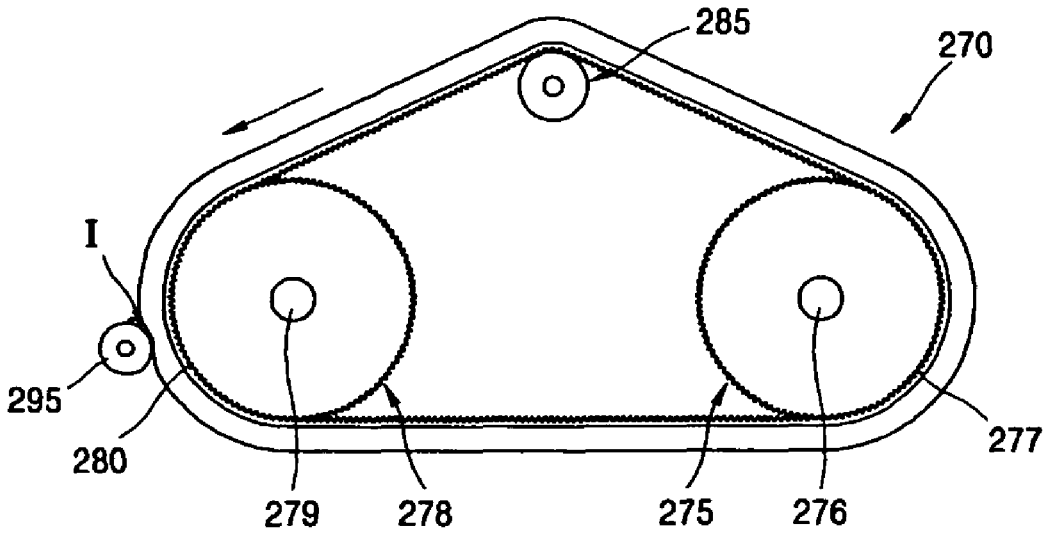
FIG. 12 is a view illustrating a cleaning device according to another embodiment of the present general inventive concept.

FIG. 12 is a view illustrating a cleaning device according to another embodiment of the present general inventive concept. For convenience of explanation, elements of which structures and effects are the same as the above-described embodiment are denoted by the same reference numerals.

Referring to FIG. 12, to remove ink I absorbed into a cleaning member 274, a second pressing unit 295 is installed. The second pressing unit 295 is installed opposite to one of either the driving pulley 275 or the idle pulley 278 to squeeze the ink I absorbed into the cleaning member 274 by pressing an outer circumference of the cleaning member 274. The second pressing unit 295 may include a porous absorbent material on its outer circumference to remove the ink I absorbed into the cleaning member 274. The ink absorbed into the cleaning member 274 is removed again using the second pressing unit 295, and therefore absorption capacity of the cleaning member 274 can be maintained and a life span of the cleaning member 274 can be extended.

Figure 13:
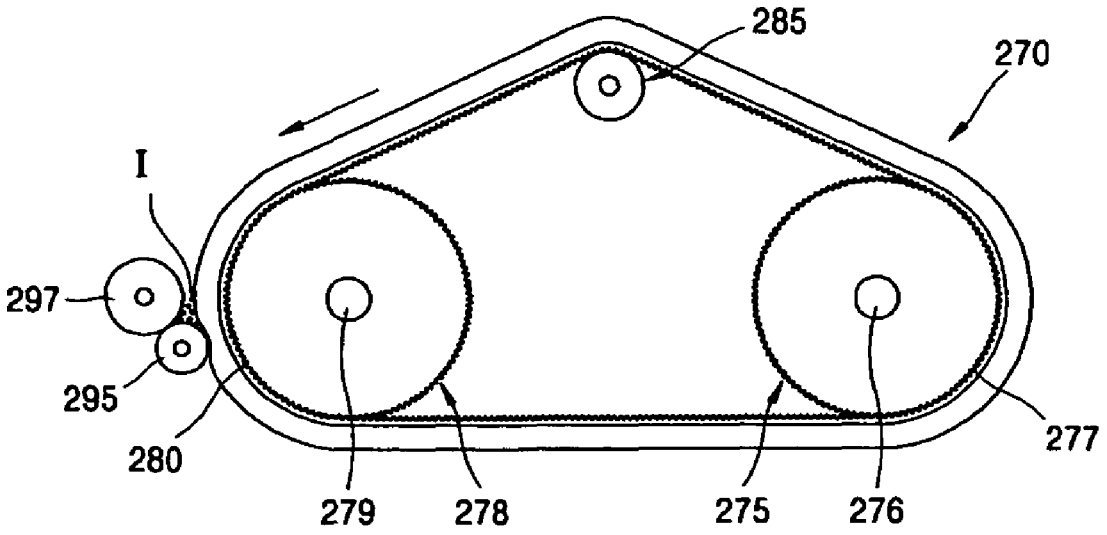
FIG. 13 is a view illustrating a cleaning device of another embodiment of the present general inventive concept.

FIG. 13 is a view illustrating a cleaning device according to another embodiment of the present general inventive concept. For convenience of explanation, elements of which structures and effects are the same as the above-described embodiment are denoted by the same reference numerals.

As illustrated in FIG. 13, a second pressing unit 295 may be installed to remove ink absorbed into a cleaning member 274. The second pressing unit 295 may be installed opposite to one of either the driving pulley 275 or the idle pulley 278 to squeeze the ink I absorbed into the cleaning member 274 by pressing an outer circumference of the cleaning member 274. A cleaning roller 297 can remove ink squeezed by the second pressing unit 295 while rotating in contact with the second pressing unit 295. A porous absorbent material may be placed on an outer circumference of the cleaning member 297. Thus, the ink absorbed into the cleaning member 274 can be further removed from the second pressing unit 295 using the cleaning roller 297 after the ink is removed from the cleaning member 274 by the second pressing unit 295, so that an absorption capacity of the cleaning member 274 can be maintained and a life span thereof can be extended.

As described above, according to the present general inventive concept, a wiper, a cleaning device, and an inkjet image forming apparatus including the wiper and the cleaning device may use a belt type wiper, thus increasing the absorption capacity of the wiper. Furthermore, since the absorption capacity of the wiper may be increased, a replacement cycle for replacing the wiper can be increased, and thus a life span of the wiper can be extended. Furthermore, a cleaning member is attached to an outer circumference of a belt member, and therefore the wiper can be driven by applying various driving methods. The cleaning member may use a porous absorbent material, thereby improving absorbency of the wiper. Ink absorbed into the cleaning member is removed again using a second pressing unit or a cleaning roller, and hence an absorbency of the cleaning member can be maintained, and a replacement cycle can be extended. A color mixing preventing unit may be formed in the cleaning member, thereby preventing waste toner removed from a nozzle array from contaminating another nozzle array. Thus, printing quality can be enhanced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A wiper comprising:

a belt member which is supported by a plurality of pulleys and circularly moves along a predetermined path; and a cleaning member which is attached to and disposed along an entire outer circumference of the belt member and removes ink adhered to a nozzle unit while rotating in contact with the nozzle unit, wherein the cleaning member comprises a color mixing preventing unit which prevents ink of a predetermined color removed from a nozzle unit during a cleaning operation from contaminating another nozzle ejecting ink of a different color, and wherein the color mixing preventing unit is a groove formed in a portion of the cleaning member at a predetermined depth, the portion corresponding to a position between adjacent nozzles ejecting ink of different colors.

2. A wiper comprising:

a belt member which is supported by a plurality of pulleys and circularly moves along a predetermined path; and a cleaning member which is attached to and disposed along an entire outer circumference of the belt member and removes ink adhered to a nozzle unit while rotating in contact with the nozzle unit, wherein the cleaning member is formed by being divided into separate portions such that each of the separate portions contacts a corresponding plurality of nozzles and each of the corresponding plurality of nozzles of the corresponding separate portion ejects a particular color of ink.

3. A cleaning device comprising:

a carrier to move in a lengthwise direction of a nozzle unit, a length of the nozzle unit corresponding to a width of a printing medium;

a driving element to move the carrier forwards and backwards; and a wiper mounted on the carrier to remove ink adhered to the nozzle unit, the wiper comprising:

a belt member which is supported by a plurality of pulleys and circularly moves along a predetermined path; and a cleaning member which is attached to an outer circumference of the belt member and removes the ink adhered to the nozzle unit while rotating in contact with the nozzle unit.

4. The cleaning device of claim 3, wherein the cleaning member includes a porous absorbent material.

5. The cleaning device of claim 3, wherein the cleaning member comprises a color mixing preventing unit which prevents ink of a predetermined color removed from a nozzle unit during a cleaning operation from contaminating another nozzle ejecting ink of a different color.

6. The cleaning device of claim 5, wherein the color mixing preventing unit is a groove formed on a portion of the cleaning member at a predetermined depth, the portion corresponding to a position between adjacent nozzles ejecting ink of different colors.

7. The cleaning device of claim 3, wherein the cleaning member is formed by being divided into portions such that each of the portions contacts nozzles ejecting ink of a same color.

8. The cleaning device of claim 3, further comprising a first pressing unit installed in the carrier to press an inner circumference of the belt member such that the cleaning member contacts the nozzle unit.

9. The cleaning device of claim 8, wherein the first pressing unit includes a roller.

10. The cleaning device of claim 8, wherein the plurality of pulleys includes a driving pulley, an idle pulley, and a first pressing unit.

11. The cleaning device of claim 3, further comprising a second pressing unit installed opposite to one of the plurality of pulleys to squeeze absorbed ink by pressing the outer circumference of the cleaning member.

12. The cleaning device of claim 11, further comprising a cleaning roller to remove the squeezed ink while rotating in contact with the second pressing unit.

13. The cleaning device of claim 12, wherein a porous absorbent material is formed on an outer circumference of the cleaning roller.

14. The cleaning device of claim 3, wherein the carrier comprises:

a housing to house the plurality of pulleys; and the plurality of pulleys further comprises:

a driving pulley mounted on a driving axis in the housing to drive the wiper circularly in the predetermined path;

an idle pulley mounted on an idle axis in the housing; and a first pressing unit to press outwardly on an inner circumference of the wiper to put tension on the wiper.

15. The cleaning device of claim 14, wherein:

the belt member includes cogs on an inner circumference thereof; and the wiper surrounds the plurality of pulleys, and each one of the plurality of pulleys includes saw teeth on an outer circumference thereof to engage the cogs.

16. The cleaning device of claim 15, wherein the driving pulley is a timing pulley to drive the wiper in the carrier.

17. The cleaning device of claim 14, wherein a pinion is attached to the driving pulley and rotatably mounted on the driving axis of the housing to engage a rack gear to circularly drive the wiper in the carrier.

18. The cleaning device of claim 14, wherein the first pressing unit includes a roller.

19. The cleaning device of claim 14, wherein the tension on the wiper by the first pressing unit is a predetermined pressure necessary to cause a distance between the first pressing unit and the nozzle unit to be less than a thickness of the wiper.

20. The cleaning device of claim 3, wherein the cleaning device further comprises:

a driving belt connected to the carrier; and a carrier drive pulley on which the driving belt engages such that when the carrier drive pulley is rotated, the driving belt rotates therewith and moves the carrier along the lengthwise direction of the nozzle unit.

21. An inkjet image forming apparatus including a cleaning device that cleans a nozzle unit having a length which corresponds to a width of a printing medium, the inkjet image forming apparatus comprising:

a carrier to move in a lengthwise direction of the nozzle unit;

a driving element to move the carrier forwards and backwards; and a wiper mounted on the carrier and to remove ink adhered to the nozzle unit, wherein the wiper comprises a belt member which is supported by a plurality of pulleys and circularly moves along a predetermined path and a cleaning member which is attached to an outer circumference of the belt member and removes the ink adhered to the nozzle unit while rotating in contact with the nozzle unit.

22. The inkjet image forming apparatus of claim 21, wherein the cleaning member includes a porous absorbent material.

23. The inkjet image forming apparatus of claim 21, wherein the cleaning member comprises a color mixing preventing unit which prevents ink of a predetermined color removed from a nozzle unit during a cleaning operation from contaminating another nozzle ejecting ink of a different color.

24. The inkjet image forming apparatus of claim 21, further comprising a first pressing unit installed in the carrier and to press an inner circumference of the belt member such that the cleaning member contacts the nozzle unit with a predetermined pressure.

25. The inkjet image forming apparatus of claim 21, further comprising a second pressing unit installed opposite to one of the plurality of pulleys to squeeze absorbed ink by pressing the outer circumference of the cleaning member.

26. The inkjet image forming apparatus of claim 25, further comprising a cleaning roller removing the squeezed ink while rotating in contact with the second pressing unit.

27. A cleaning device to clean a print head with a plurality of rows of nozzles, each of the plurality of rows of nozzles to eject a color of ink, the cleaning device comprising:

a carrier; and a wiping unit mounted on the carrier, the wiping unit comprising:

a belt member; and a cleaning member disposed along an entire outer circumference of the belt member, including a color mixing preventing unit to prevent each of the plurality of rows from being contaminated by other colors of ink.

28. A cleaning device to clean a print head of an image forming apparatus with a plurality of rows of nozzles, each row corresponding to a different color ink, the cleaning device comprising:

a carrier; and a wiping unit mounted on the carrier, the wiping unit comprising:

a belt member; and a cleaning member disposed along an entire outer circumference of the belt member, the cleaning member being divided into portions such that each of the portions cleans a different row of nozzles.

29. A inkjet image forming apparatus including a cleaning device to clean a print head with a plurality of rows of nozzles, each of the plurality of rows of nozzles to eject a color of ink, the inkjet image forming apparatus comprising:

a carrier; and a wiping unit mounted on the carrier, the wiping unit comprising:

a belt member; and a cleaning member disposed along an entire outer circumference of the belt member, including a color mixing preventing unit to prevent each of the plurality of rows from being contaminated by other colors of ink.

30. An inkjet image forming apparatus including a cleaning device to clean a print head with a plurality of rows of nozzles, each row corresponding to a different color ink, the inkjet image forming apparatus comprising:

a carrier; and a wiping unit mounted on the carrier, the wiping unit comprising:

a belt member; and a cleaning member disposed along an entire outer circumference of the belt member, the cleaning member being divided into portions such that each of the portions cleans a different row of nozzles.

* * * * *